United States Patent [19]

Halfaker

[11] 4,437,287

[45] Mar. 20, 1984

[54] CEILING PANEL

[75] Inventor: Thomas C. Halfaker, Tupelo, Miss.

[73] Assignee: Emerson Electric Co., St. Louis, Mo.

[21] Appl. No.: 352,190

[22] Filed: Feb. 25, 1982

[51] Int. Cl.[3] ..... E04B 1/82; E04B 1/38; E04B 1/74

[52] U.S. Cl. ..... 52/588; 52/145; 52/406

[58] Field of Search ..... 52/588, 595, 145, 406, 52/332

[56] References Cited

U.S. PATENT DOCUMENTS

| | | | |
|---|---|---|---|
| 3,267,626 | 8/1966 | Daly | 52/145 |
| 3,304,680 | 2/1967 | Birdwell | 52/588 X |
| 3,479,784 | 11/1969 | Massagli | 52/588 |
| 3,514,915 | 6/1970 | Johnson | 52/588 X |
| 3,708,940 | 1/1973 | Harman | 52/588 |
| 4,104,840 | 8/1978 | Heintz et al. | 52/595 X |
| 4,171,599 | 10/1979 | Lipp | 52/588 X |
| 4,228,624 | 10/1980 | Reneault et al. | 52/588 X |
| 4,316,351 | 2/1982 | Ting | 52/595 X |

FOREIGN PATENT DOCUMENTS

| | | | |
|---|---|---|---|
| 641946 | 8/1950 | United Kingdom | 52/588 |
| 2049008 | 12/1980 | United Kingdom | 52/588 |

*Primary Examiner*—J. Karl Bell

*Attorney, Agent, or Firm*—Polster, Polster and Lucchesi

[57] ABSTRACT

In a ceiling comprised of rectangular metal ceiling panels each having a perforate face panel and an imperforate back panel spaced from one another, the side and end margins of the face and back panels being defined by the bend of lips integral with the panel, the lips of face and side panels being joined to form side and end walls, the end walls are provided with an inverted, open-mouthed channel, offset inboardly with respect to the back panel and intermediate the height of the end wall between the face and back panel, and the side walls of contiguous ceiling panels are provided with an outwardly opening cove along one panel and an outboardly projecting tongue in the contiguous panel.

5 Claims, 10 Drawing Figures

CEILING PANEL

BACKGROUND OF THE INVENTION

Heretofore the standard method of constructing ceiling panels with perforate face panels and imperforate back panels has been to bend an L-shaped lip along both end margins and one side margin of both panels, with the foot of the face panel wider than the foot of the back panel, and to crimp the outer margin of the face panel lip around the outer edge of the foot of the back panel lip to form a projecting ledge approximately centered between the face and back panel. On the remaining side, the back panel lip has extended to the level of the upper surface of the face panel, and has been bent to form an upwardly opening channel with its bottom surface flush against a portion of the top surface of the face panel. The face panel has had a marginal lip bent up along a channel-defining outer wall of the back panel lip and crimped over the top edge of the outer wall to form a joint. The projecting ledge of a contiguous panel extended over the space provided by the open-topped channel. At the ends of the panel, the projecting seam rested on an upright wall of a grid-type ceiling support.

This prior art construction had at least two disadvantages. Along the sides, the superposition of the unperforated back panel lip forming the channel along one side interferes with the sound absorption function of the perforations and is visible when the panel is in place in the ceiling, which detracts from the appearance of the ceiling. At the ends, there is no positive interengagement between the grid member and the panel.

One of the objects of the present invention is to provide a construction in which the perforations of the face panels of contiguous ceiling panels are unobstructed and extend to the very margins at which the panels meet.

Another object is to provide a construction in which the panels have a positive engagement with the grid members supporting them, in such a way as to inhibit accidental dislodgment and to ensure a close fit between the contiguous side wall and the grid member.

Another object is to provide a construction in which the panels interengage with one another so as to inhibit unwanted seperation and accidental dislodgement.

Other objects will become apparent to those skilled in the art in the light of the following description and accompanying drawing.

SUMMARY OF THE INVENTION

In accordance with this invention generally stated, in a ceiling comprised of rectangular metal ceiling panels having a face panel and a back panel spaced from one another, the side and end margins of each being defined by the bend of a lip integral with the panel, the lips of the face and back panels being joined to form side and end walls, ceiling panels are provided in which each end margin of the back panel extends beyond the end margin of the face panel along the end wall, the upturned lip of the face panel being bent along its outer edge first outboardly to form a channel bottom and thence toward the plane of the face panel at an obtuse angle with respect to the channel bottom to define an outboardly tending channel wall, thence toward the back panel to face-to-face engagement with the downturned lip of the back panel. A downwardly opening channel, offset inboardly with respect to the back panel and extending outboardly with respect to the face panel is thus formed. The upright part of the grid member extends into the channel, and the slope of the outer channel-defining wall ensures that the panel and grid member are cammed into close engagement.

The side walls of contiguous ceiling panels are provided respectively with a cove and a tongue projecting into the cove. The cove is formed by bending the lip of the back panel reentrantly at an acute angle to the plane of the back panel and then arcuately so that its outer margin is directed outboardly. The upturned lip of the face panel is bent inboardly intermediate its outer margin and then arcuately complementarily to the lip of the back panel to meet and nest in the back panel lip and define a cove extending lengthwise of the side wall. The arcuate parts of the lips also form a sliding hinge. The tongue of the contiguous is made up by forming a gutter along the outer edge of the back panel side lip, the gutter bottom being at an obtuse angle with respect to the plane of the back panel. An intermediate part of the upturned lip of the face panel is bent outboardly at an acute angle complementarily to the obtuse angle of the gutter bottom, thence on a radius, around the outer margin of the gutter, and back within the gutter into engagement with the inboard surface of the gutter-defining margin of the back panel lip. The outer margins of the tongue and the cove are about midway of the height of the side wall, although preferably there is a small amount of clearance between the tongue and cove.

In one embodiment, the cove has a lower outer surface substantially parallel to the plane of the back panel and the tongue extends downwardly outwardly at a shallow angle, e.g., 15° from a plane parallel to the back and face panels. In another embodiment, the tongue angle is steeper, e.g., 30°, the lower outer surface of the cove extends inwardly downwardly at an angle complementarily to that of the tongue, and the distance the tongue projects from the side and the depth of the cove is such that although there is normally a space between the tongue and the cove, lateral movement of one panel away from the other will cause the tongue and cove surfaces to engage, inhibiting further movement. Such a construction of the tongue will also permit its use as a support surface with a grid rail.

An intermediate sound trap baffle or membrane can be supported by the internal ledges provided by the end channels, and if desired, by being sandwiched between the underside of the gutter and the upper surface of the tongue-forming intermediate part of the face panel lip. The baffle itself is preferably perforate as is the face panel, and preferably either hipped in a shallow pyramidal shape, or corrugated lengthwise of the panel, to improve its sound scattering characteristics and rigidity. The back panel is preferably imperforate, but can be made perforate if desired, to permit the passage of air, for example. It may be formed with reinforcing ribs or the like, either made integrally with or separately secured to the back panel.

DESCRIPTION OF THE PREFERRED EMBODIMENT

Figure 2:
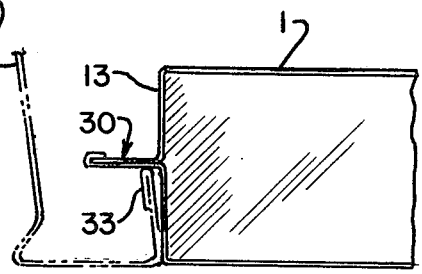
FIG. 2. PRIOR ART
FIG. 2 is a fragmentary longitudinal sectional view of a prior art panel.
Figure 3:
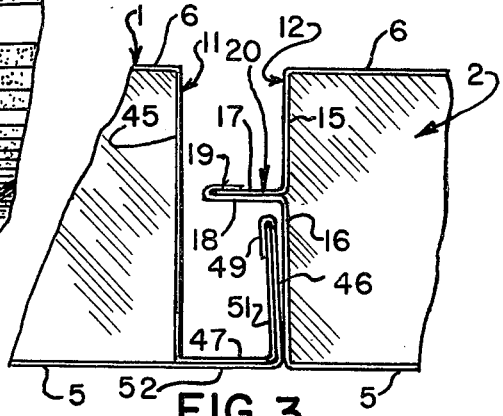
FIG. 3. PRIOR ART
FIG. 3 is a fragmentary transverse sectional view of contiguous prior art panels.

Referring now to the drawing, and particularly to FIGS. 2 and 3 for an illustration of the conventional prior art ceiling panel of which the present invention is an improvement, reference numeral 1 indicates one of two contiguous ceiling panels, the other of which is indicated by reference numeral 2. Each of the ceiling panels has a perforate face panel 5 and an imperforate back panel 6, both substantially planar and separated by side walls 11 and 12 and end walls 13, the end walls 13 being identical at the two ends. In the embodiment of prior art panel described, each of the panels 1 and 2 has a side wall 11 and a side wall 12. The margins of the back panel 6 and face panel 5 are defined by bends, substantially at right angles to the plane of the panels, of lips integral with the panels. As illustrated in FIG. 3, side lip 15 of the back panel is L-shaped, with a foot 17 projecting outboardly parallel to the back and face panels. A face panel side lip 16 is also L-shaped, with a foot 18 engaging the undersurface of the foot 17, and with a marginal part 19 crimped over the outer edge of the foot 17 of the back panel so as to form an outwardly projecting ledge 20, extending substantially the length of the side of the ceiling panel.

Both end walls 13 of both panels 1 and 2 are made in the same way as side wall 12, to provide an end ledge 30 which, resting upon an upright wall 33 of a grid member 34, supports the panel in a ceiling.

It can be seen that, except for the interruption at the corners inherent in forming integral lips, ledges 20 and 30 extend around the entire perimeter of the panel except along the side 11. At the side wall 11 a downturned back panel lip 45 extends to the upper surface of the front panel 5, is then bent outboardly parallel to the front panel to form a channel bottom-defining foot 47 and thereafter is bent up at a slightly acute angle to define an inside wall 51. The face panel 5 has a marginal section 52 lying in the plane of the face panel, a lip 46 in face-to-face engagement with the outboard surface of the wall 51, and a lip margin 49 crimped over the outer edge of the wall 51 of the back panel lip 45.

Figure 1:
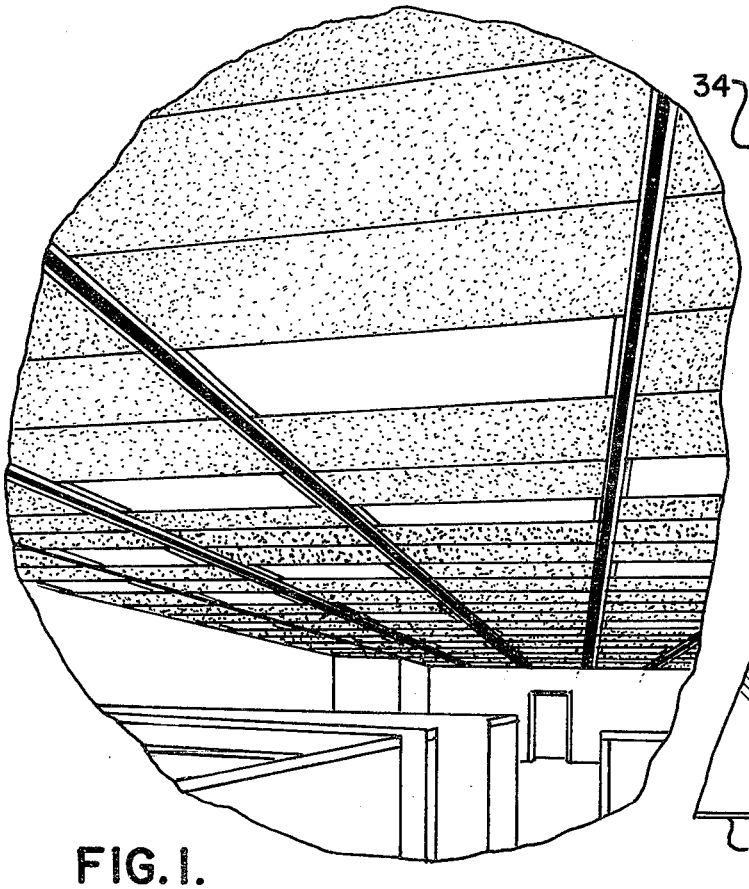
FIG. 1 is a view in perspective of a ceiling formed of panels of this invention.

Referring now to FIG. 1, reference numeral 70 indicates a ceiling of this invention made up of ceiling panels of which ceiling panels 71 and 72 are a part. The ceiling panels 71 and 72 are supported at their ends by grid members 34 which can be identical to the grid member illustrated in connection with the prior art panels. Although, as will be explained, ceiling panels of this invention can be made with tongues along both sides, the invention will be described for illustration purposes in terms of ceiling panels with tongues along one side and coves along the opposite side, so that panels 71 and 72 are, in this embodiment, identical.

Figure 4:
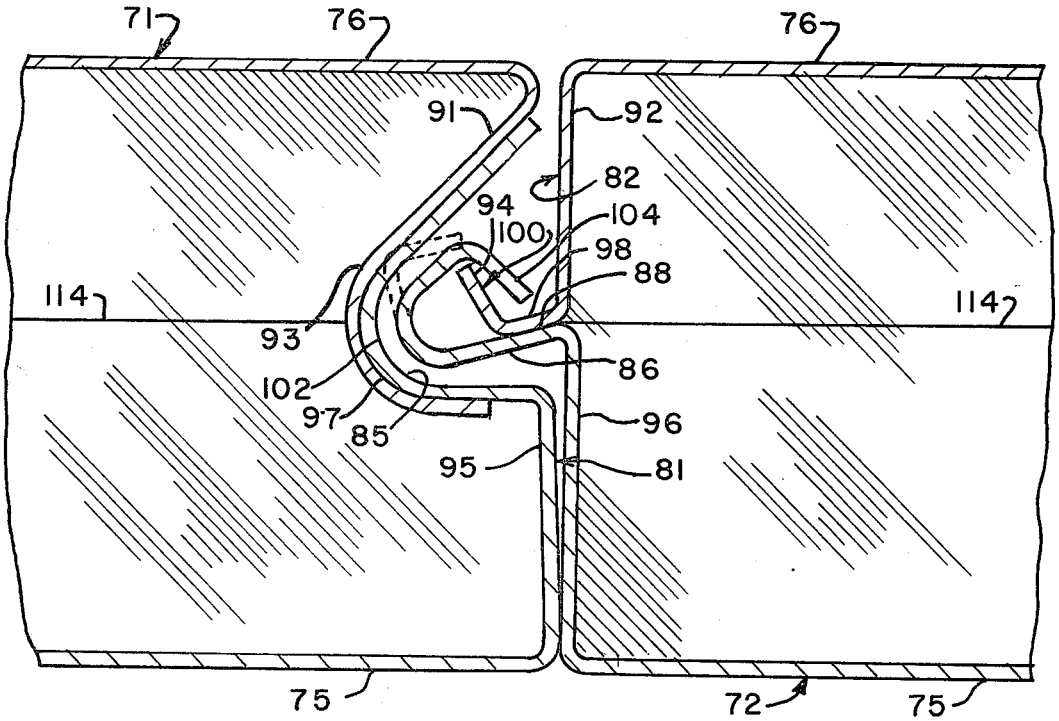
FIG. 4 is a fragmentary transverse sectional view of contiguous panels of one embodiment of this invention.

Referring now to FIG. 4, ceiling panels 71 and 72 have face panels 75 and back panels 76, side walls 81 and 82, and end walls 83. The ceiling panel 71 has along its side wall 81, a cove 85. The cove 85 is formed by bending a downturned back panel lip 91 to a reentrant, acute angle, for example 45°, with respect to the plane of the back panel, thence bending the outer margin of the lip 91 arcuately outboardly, to form a seat 93 opening outboardly. An upturned face panel lip 95, bent up at a slightly acute angle, for example, 89°, is bent at its upper margin first sharply inboardly, then arcuately complementarily to the arcuate seat 93, to form a bearing section 97 which engages and nests within the seat 93, serving as a convex hinge part on one surface and defining a concave, tongue receiving recess on the other.

Ceiling panel 72 has along its side wall 82 a tongue 86. The tongue is formed by bending a downturned lip 92 of the back panel 76 first substantially perpendicularly to the plane of the back panel 76, then at an obtuse angle with respect to the lip 92, for example, 105°, to form an outboardly downwardly sloping bottom wall 98, thence, at an obtuse angle, for example, 92°, to the bottom wall 98 to form an upwardly outboardly directed wall 94, the wall 94, bottom 98 and a portion of the lip 92 intermediate the back panel and wall 98 defining a gutter 100. A lip 96 is bent up from the face panel 75, at a slightly acute angle, for example, 89°, to the face panel, thence at an acute angle to the riser portion of the lip to form a shelf 88, the angle being complementary to the angle of the bottom wall 98. The upper surface of the shelf 88 and bottom surface of the wall 98 engage, but the outer margin of the lip 96 is wide and projects substantially beyond the bottom wall 98, whence it is bent on a radius to form a nose 102. The outer margin 104 of the lip is then bent back over the outer edge of the gutter wall 94 and into engagement with the inner surface of the gutter wall 94 and the upper surface of the bottom wall 98 to join the back panel and face panel lips, hence the face and back panels.

Figure 5:
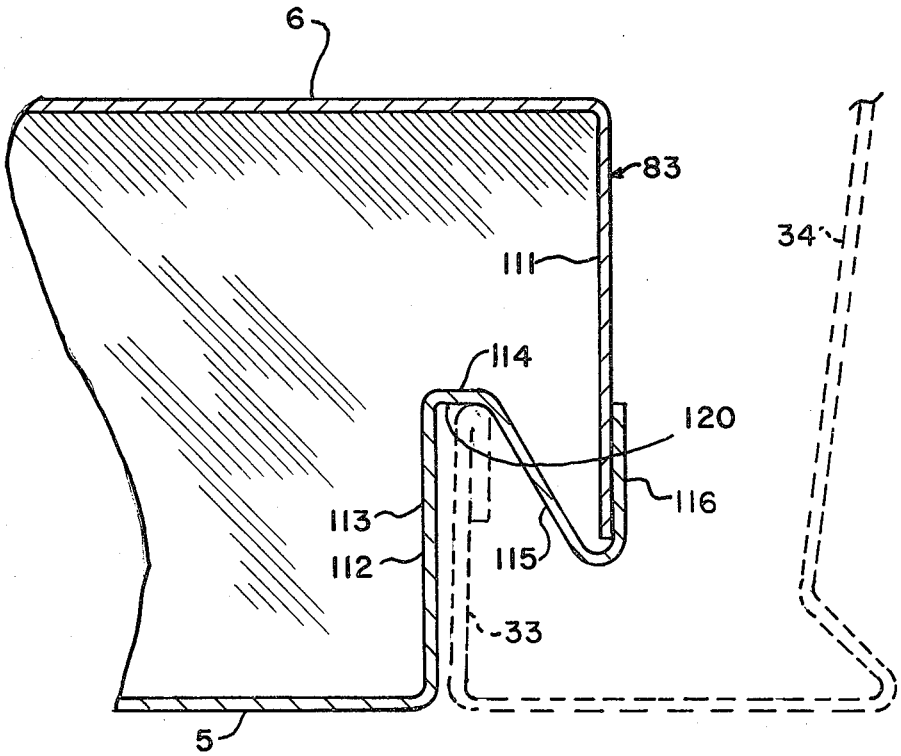
FIG. 5 is a fragmentary longitudinal sectional view of a panel of one embodiment of this invention.
Figure 6:
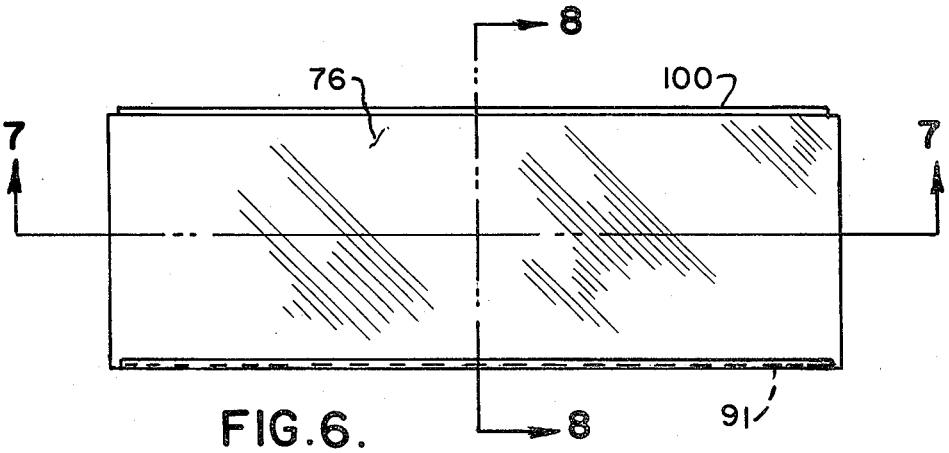
FIG. 6 is a top plan view of a reduced scale of a panel of this invention.
Figure 7:
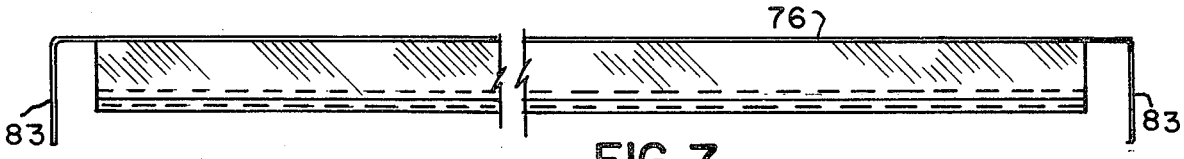
FIG. 7 is a sectional view slightly enlarged taken along a line 7—7 of FIG. 6.
Figure 8:
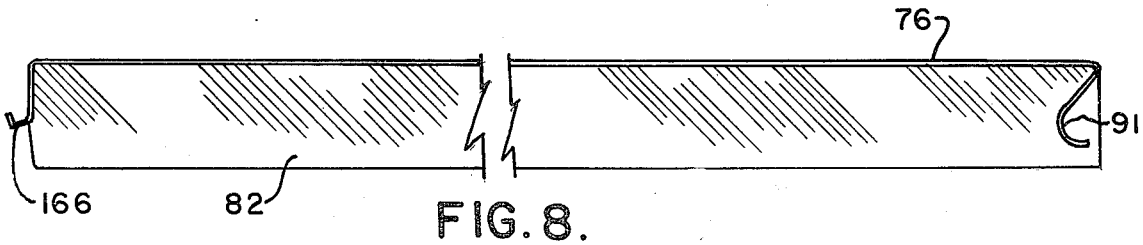
FIG. 8 is a sectional view slightly enlarged taken along a line 8—8 of FIG. 6.

The end walls 83 of panels 71 and 72 are identical. As shown in FIG. 5, a back panel end lip 111 is bent downwardly perpendicularly to the back panel 6. A front panel end lip is upturned from the front panel 5 at a position with respect to the length of the panel offset inboardly from the lip 111. The lip 112 has a first upright portion 113, at the upper margin of which it is bent at substantially right angles to form a channel bottom wall 114, thence at an obtuse angle, for example, 120°, to the channel bottom wall, to form a downwardly outwardly tending channel camming wall 115, thence on a small radius, upwardly along an outer margin 116, parallel with and in engagement with the outboard surface of the back panel end lip 111. The lip 112 thus defines a grid wall-receiving inverted channel 120.

In making the panels 71 and 72, all of the forming of the panels and lips can be completed except for the bending of the nose 102. Insulating batting can be placed in the formed face panel, the back panel can be inclined toward the side wall 81, the seat 93 can be slipped around the bearing section 97, the back panel can be closed down against the shelf 88, and the nose 102 and outer margin 104 rolled around the gutter wall 94 to lock the panel together. The back panel end lip fits snugly against the inner surface of the outer margin 116 of the face panel lip 112, but need not be adhered, popriveted, or spot welded to it, although it can be. The complementary arcuate surfaces of the seat 93 and bearing section 97 permit the back panel to hinge and at the same time seat positively, so as to ensure a tight seam along the side wall 81.

The panels are supported at their ends by the engagement of the grid member wall with the inverted channel 120. The slope of the outer channel wall 115 ensures that the contiguous surfaces of the grid member and face panel lip 112, particularly at the margin of the face panel 5, will be close together. Furthermore, in order to shift the ceiling panel with respect to the grid member, the panel must be lifted, so that accidental dislodgment by mere shifting of the panel with respect to the grid member is prevented.

Preferably, the tongue 86, though projecting into the cove 85, does not engage the wall defining the cove. The function of the tongue and cove is to form a baffle against the passage of light, sound, and air through any space between contiguous panels. By making provision for a small amount of clearance between the tongue and the cove surfaces, allowance is made for manufacturing tolerances (conventionally +/− 1/64"), which might, under extreme circumstances, lead to a detectable misalignment of contiguous panels if the tongue rested on the adjacent surface of the cove.

Recessed lighting fixtures of the type use in ceilings such as the ceiling 70 are provided with side flanges corresponding to the side flanges of conventional ceiling panels 2, which can be received in the cove of the panels of the present invention without modification. In a ceiling section in which ceiling panels of the present invention are expected to flank a lighting fixture in areas of the ceiling, they will be arranged so that two cove sides face one another. For simplicity, certain of the ceiling panels of this invention can be made with tongues on both side walls to take the place of such lighting fixtures in those areas in which the fixtures are not used. This lends flexibility to the ceiling, because the lighting fixtures can be moved from place to place without having to rearrange the ceiling panels.

Figure 9:
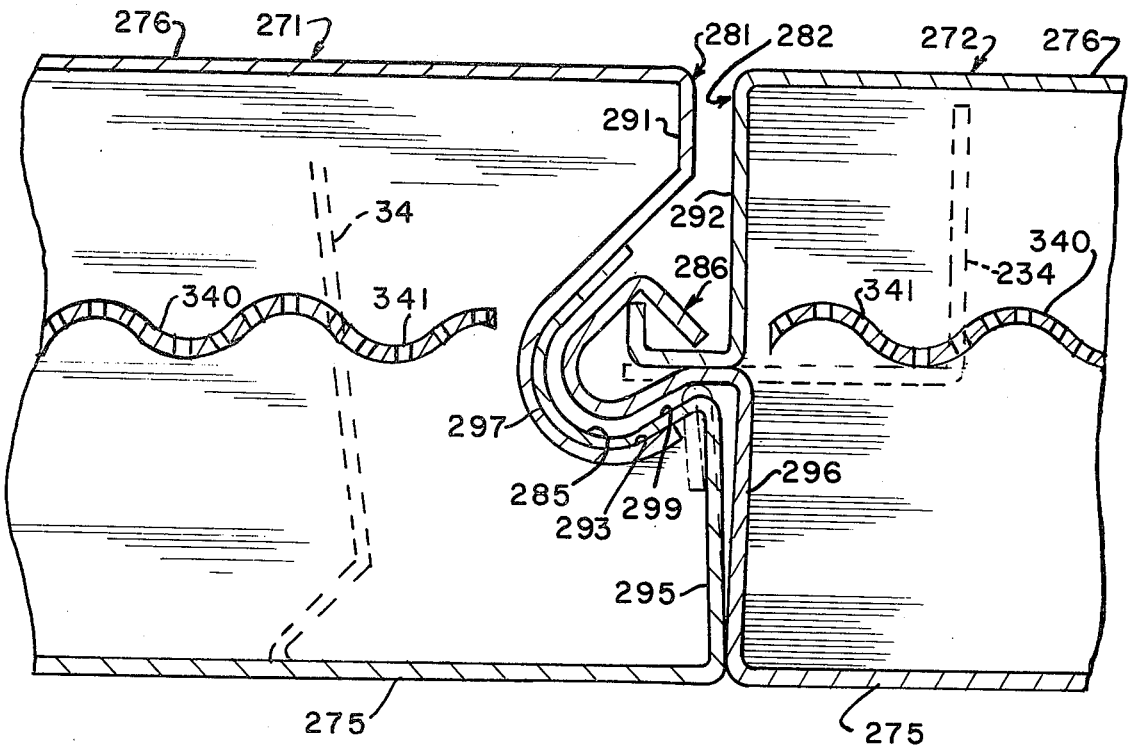
FIG. 9 is a sectional view corresponding to the view in FIG. 4, of another illustrative embodiment of panel of this invention.
Figure 10:
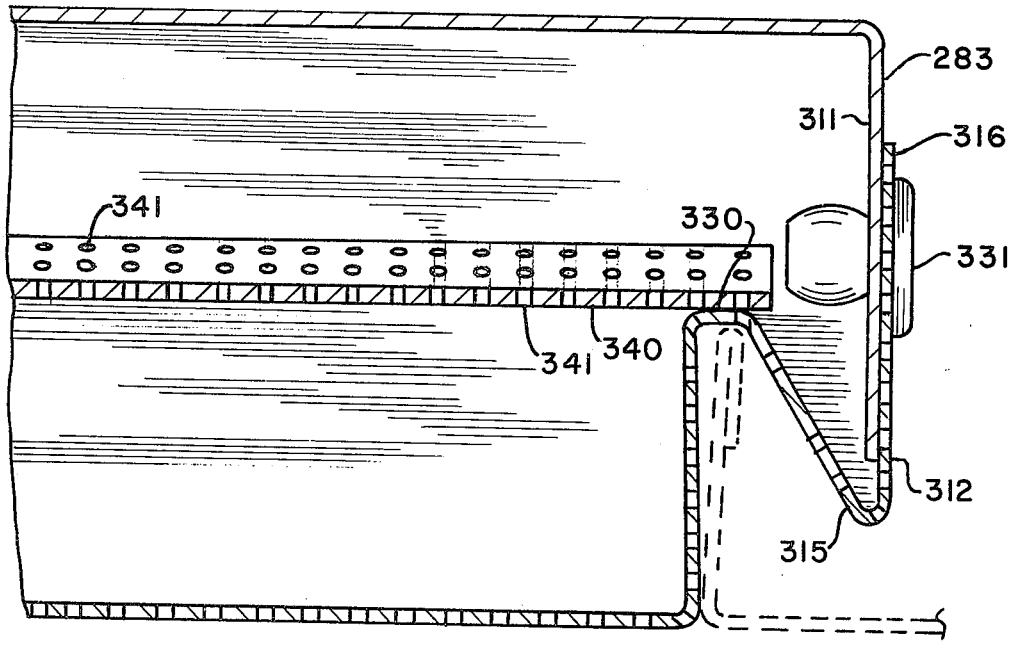
FIG. 10 is a sectional view corresponding to the view in FIG. 5, of the embodiment shown in FIG. 9.

Referring now to FIGS. 9 and 10 for another embodiment of ceiling panel of this invention, reference numerals 271 and 272 indicate two contiguous panels, each with a face panel 275 and a back panel 276, side walls 281 and 282, and end walls 283. The panel 271 has a cove 285, formed in the same steps as the cove 85 of the first embodiment. However, in this embodiment, a back panel lip 291 is bent down substantially perpendicularly to the plane of the back panel, thence at a 45° angle, thence, at its outer margin, in an arc of approximately 180° about a radius, to form a seat 293 that opens outwardly upwardly, and terminates in approximately the plane of the perpendicular part of the lip 291. An upturned face panel lip 295 is bent up as the lip 95 was bent, at a slightly acute angle, but then is bent at a reentrant angle complementary to the angle of the outermost edge of the lip 291 and then arcuately complementarily to the arcuate seat 293 to form a bearing section 297 which engages and nests within the seat 293, serving as a convex hinge part on its lower surface and defining a downwardly inwardly extending tongue-receiving recess with a tongue-engaging slope 299 on the other.

The ceiling panel 272 has along its side wall 282 a tongue 286. The tongue 286 is formed by bending a lip 292 of the back panel 276 first substantially perpendicularly to the back panel 276, then at substantially a right angle outwardly, thence, at its outer margin, substantially perpendicularly. A lip 296 is bent up from the face panel 275 at a slightly acute angle, thence outwardly at right angles, to form an upper surface that will abut the lower surface of the outwardly directed portion of the lip 292, thence downwardly at an angle complementary to the angle of the slope 299, whence it is bent upon a radius to form a nose 302. The outer margin of the lip is then bent back over the outer edge of the upwardly projecting edge of the lip 292. The tongue and cove of this embodiment differ from the tongue and cove of the first embodiment particularly in that, when the two panels are mounted as shown in FIG. 9, the tongue 286 extends below the top of the upper edge of the slope 299 of the cove. Thus, although there is normally a space between the tongue 286 and the cove 285, if the panels 271 and 272 move laterally apart, the underside of the tongue 286 will engage and cam against the slope 299, inhibiting unintentional separation of the two ceiling panels, and tending to restore them to their proper relation.

A grid member 34 is shown in dotted lines in FIG. 9, merely to indicate how the tongue 286 can be used to support a ceiling panel 272 in the absence of the panel 271. Similarly, a fixture flange 234 is shown in dotted lines to illustrate its relation to the cove of the panel 271 in the absence of the panel 272.

The end walls 283 of panels 271 and 272 are identical. They are in most respects the same as the end walls 83 of panels 71 and 72, except that a back panel end lip 311 has a series of rivet holes in it, a channel camming wall 315 of front panel end lip 312 is shown as provided with a steeper angle, and an outer margin 316 is accordingly bent up at a more acute angle so as to engage the outboard surface of the back panel end lip 311, extends farther up the lip 311, and is provided with rivet holes aligned with rivet holes in lip 311 to permit the insertion of pop rivets 331.

In the embodiment shown in FIGS. 9 and 10, a perforate membrane or partition 340 is provided which, in the illustrative embodiment shown, extends the length of the panel inboard of the inner surface of the side walls 281 and 282, and supported at its ends on an upper surface 330 of the front panel end lip 312, as shown in FIG. 10. In the embodiment, the partition 340 is corrugated, to provide rigidity and to increase the scattering of sound. It can also be made hipped or otherwise nonplanar, or, if the material is sufficiently stiff, or if one long edge of the membrane is sandwiched between the lips of the side wall 82 or 282, the partition can be made planar.

It can be seen that either embodiment of ceiling panel can be equipped with the membrane, the provision of a channel inboard of the outer reach of the end walls providing a supporting shelf at both ends.

Numerous variations in the construction of the ceiling panels of this invention, within the scope of the appended claims, will occur to those skilled in the art in the light of the foregoing disclosure.

I claim:

1. In a ceiling comprised of rectangular metal ceiling panels having a face panel and a back panel spaced from one another, the side and end margins of each said face and back panel being defined by the bend of a lip integral with said panel, the lips of said back and face panels being joined to form side and end walls connecting said face and back panels, the improvement comprising each end margin of said back panel's extending beyond the end margin of said face panel along the said end wall, the end lip of said back panel extending in a direction toward said face panel and the end lip of said face panel along said end margin being bent upwardly and then outboardly to form a channel bottom, thence toward said face panel at an obtuse angle with respect to said channel bottom to define an outboardly tending channel wall, thence toward said back panel to face-to-face engagement with said back panel end lip.

2. The improvement of claim 1 including a membrane the ends of which rest upon and are supported by an upper surface of said channel bottom.

3. In a ceiling composed of rectangular metal ceiling panels having a perforate face panel and an imperforate back panel, both substantially planar, spaced from one another, the side and end margins of each said face and back panel being defined by the bend of a lip integral with said panel, said lips being joined to form side and end walls connecting said front and back panels, the improvement comprising the side wall defining lip of said back panel of one of two contiguous of said ceiling panel's being bent reentrantly at an acute angle to the plane of the back panel, the side wall defining lip of the face panel being bent inboardly intermediate its outer margin to meet said back panel lip and define a cove extending lengthwise of said side wall, and the other of said contiguous panels having a tongue extending along its contiguous side wall and into said cove and wherein the tongue of the contiguous panel comprises a gutter formed along the outer edge of the back panel side lip, said gutter having a bottom wall and an outboard side wall, said face panel having an upturned lip, an intermediate shelf section of said lip extending along, beneath and in engagement with an outer surface of said bottom wall of said gutter at an obtuse angle with respect to the plane of the face panel, tending toward said plane in an outboard direction, a nose section of said face panel side lip extending beyond said gutter bottom and around said gutter side wall, and an outer margin of said face panel side lip being bent over the outer margin of the back panel lip, and into engagement therewith to join said lips, hence said front and back panel.

4. In a ceiling composed of rectangular metal ceiling panels having a perforate face panel and an imperforate back panel, both substantially planar, spaced from one another, the side and end margins of each said face and back panel being defined by the bend of a lip integral with said panel, said lips being joined to form side and end walls connecting said front and back panels, the improvement comprising the side wall defining lip of said back panel of one of two contiguous of said ceiling panel's being bent reentrantly at an acute angle to the plane of the back panel, the side wall defining lip of the face panel being bent inboardly intermediate its outer margin to meet said back panel lip and define a cove extending lengthwise of said side wall, and the other of said contiguous panels having a tongue extending along its contiguous side wall and into said cove and wherein at each end of said ceiling panels the end margin of the back panel extends beyond the end margin of the face panel, the end lip of said back panel extending in a direction toward said face panel, the lip of said face panel along said end margin being upturned at a position offset inboardly from the end lip of the back panel, bent outboardly intermediate its width to form a channel bottom, thence toward said face panel at an obtuse angle with respect to said channel bottom to define an outboardly tending channel wall, thence toward said back panel to face-to-face engagement with said back panel lip.

5. The improvement of claim 4 including a membrane the ends of which rest upon and are supported by an upper surface of said channel bottom.

* * * * *